US006517262B2

(12) United States Patent
Twist et al.

(10) Patent No.: US 6,517,262 B2
(45) Date of Patent: Feb. 11, 2003

(54) PROCESSING PHOTOGRAPHIC MATERIAL

(75) Inventors: Peter J. Twist, Great Missenden (GB); Anthony Earle, Harrow Weald (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/973,214

(22) Filed: Oct. 9, 2001

(65) Prior Publication Data

US 2002/0054767 A1 May 9, 2002

(30) Foreign Application Priority Data

Nov. 3, 2000 (GB) ..... 0026950

(51) Int. Cl.[7] ..... G03D 3/04; G03D 3/08
(52) U.S. Cl. ..... 396/625; 396/634
(58) Field of Search ..... 396/604, 633–635, 396/625; 355/27–29

(56) References Cited

U.S. PATENT DOCUMENTS

| | | | | | |
|---|---|---|---|---|---|
| 1,347,032 | A | * | 7/1920 | Hammond | 242/536 |
| 2,203,963 | A | * | 6/1940 | Lange | 396/597 |
| 3,377,938 | A | | 4/1968 | Patterson | 396/576 |
| 3,668,997 | A | | 6/1972 | Ratowsky | 396/625 |
| 3,728,953 | A | * | 4/1973 | Morse | 134/94.1 |
| 4,277,159 | A | * | 7/1981 | Descotes | 366/213 |
| 4,439,033 | A | * | 3/1984 | Freeman | 396/603 |
| 4,444,480 | A | * | 4/1984 | Freeman | 396/603 |
| 5,266,994 | A | | 11/1993 | Desai et al. | 396/604 |
| 5,365,299 | A | | 11/1994 | Desai | 396/571 |
| 5,414,485 | A | | 5/1995 | Fyson | 396/633 |
| 5,555,234 | A | | 9/1996 | Sugimoto | 396/604 |

FOREIGN PATENT DOCUMENTS

| | | |
|---|---|---|
| DE | 590537 | 1/1934 |
| DE | 3242810 | 5/1984 |
| EP | 0 926 553 | 6/1999 |
| GB | 2335291 | 9/1999 |
| NL | 288055 | 1/1963 |

OTHER PUBLICATIONS

JP Abstract: 7,130,616; JP Abstract: 11026367; JP Abstract; 63116432; DE Abstract: 3,242,810.

* cited by examiner

*Primary Examiner*—D. Rutledge
(74) *Attorney, Agent, or Firm*—Frank Pincelli

(57) ABSTRACT

An apparatus for processing photographic material comprises a chamber adapted to hold the material therein, means for introducing solution into the chamber, means for removing the solution from the chamber, and a member located within the chamber and filling a central part thereof. A gap is defined between the inner wall of the chamber and the central member in which the material is held, thereby retaining the material around the inner circumference of the chamber.

35 Claims, 4 Drawing Sheets

PROCESSING PHOTOGRAPHIC MATERIAL

FIELD OF THE INVENTION

This invention relates to a method and apparatus for processing photographic material. In particular, the invention relates to a method of processing which uses a low volume of processing solution.

BACKGROUND OF THE INVENTION

Conventional processing of photographic material requires the use of large tanks of processing solutions. Each tank contains a processing solution such as developer, bleach, fixing solution or washing solution. The material is transported through each tank in turn. There is a tendency for the solutions to carry over from one tank to another leading to pollution of the solutions. Conventional processing has several other drawbacks. The temperatures which can be utilized are limited and therefore the process is slow. The composition of the solutions must be stable over long time residence periods in the processing tanks. Replenishment of the solutions is difficult to control. The processing apparatus is also very large due to the number of processing tanks and the apparatus is limited to only one type of process.

To overcome the problems of conventional deep tank processing surface application of the processing chemicals was developed. In previous surface application methods a volume of solution is applied to the surface of the material being processed. However, previous surface application methods have several drawbacks. If the solution applied to the material is just left on the sensitized surface of the material in a static condition the processing will be very slow and inefficient because there is no agitation and by-products accumulate in the material and solution layers, slowing down the processing. This method is also prone to non-uniformity of processing.

It is also known to process the material within a rotary tube. The material to be processed is placed emulsion side facing inwards within the tube. Solution is added and the tube rotated. Large volumes of processing solution (70 ml/sq.ft and upwards) will process the material effectively so long as rotation is not so fast as to cause dispersion of the solution puddle. Rapid rotation of the device is however very desirable to quickly and evenly distribute a given small volume of solution over the whole surface of the material so that processing is uniform from one end to the other. If the rotation is too slow there will be seasoning of the small volume of solution by the front end of the material and processing will be different at the back end of the material. Small volumes of processing solution (50 ml/sq.ft or less) do not properly process film or paper because when the device is rotated, even at low speeds of rotation, the solution puddle is dispersed and spread over the whole surface of the material. Consequently there is no agitation. This leads to several processing defects. Processing is similar to that already described and can be streaky, non-uniform and slow because of local consumption and the production of by-products. There is no surface mixing and chemical economy is therefore low.

Co-pending application GB 0023091.2 discloses a processor having a cylindrical chamber which is rotated during processing. Film is loaded around the inner circumference of the chamber when the chamber is stationary. One method of loading film into the chamber of the processor is to provide an entry slot in the outer circumference and feed the film through the slot and round the inner circumference. The film is driven by a pair of rollers just outside the entry slot. This method has been described in the above mentioned co-pending application, in which edge guides are also provided to keep the film against the inner circumference and prevent it falling into the centre of the chamber. The edge guides overlap the film edges on both sides by about 2 mm thus providing film retention and also free access of processing solution to the image area and back of the film.

The method described in the above-mentioned application is very effective. However, it can only apply to a fixed film width such as 35 mm or 24 mm (APS). Both widths of film cannot be processed in the same chamber. It has been found that when one side of a 24 mm film is fed into one of the edge guides of a chamber designed for 35 mm film, the 24 mm film will sometimes fall out before loading is complete. The 24 mm film is then not properly loaded and cannot be processed. A chamber designed for film 24 mm wide clearly cannot accept film 35 mm wide. To overcome these difficulties a new apparatus and method of loading the film has been designed and this is the subject of the present application.

SUMMARY OF THE INVENTION

According to the present invention there is provided an apparatus for processing photographic material comprising a chamber adapted to hold the material therein, means for introducing solution into the chamber, means for removing the solution from the chamber, and a member located within the chamber and filling a central part thereof, a gap being defined between the inner wall of the chamber and the central member in which the material is located, thereby to retain the material around the inner circumference of the chamber.

The central member can be made of a material which does not damage the emulsion on the film. Preferably the inner circumferential wall of the chamber is made of the same material. The inner wall may also be provided with rollers to reduce the friction and damage. However this is not an essential feature of the invention.

Advantageously the apparatus may be provided with a double slot edge guide entry to further facilitate film of two widths being loaded into the same chamber. However this is not an essential feature of the invention.

The invention further provides a method of processing photographic material comprising the steps of loading the material into a processing chamber the central part of which is filled by a central member, the walls of the chamber and the central member defining a gap in which the material is located, introducing processing solution into the chamber, agitating the solution and removing the solution from the chamber.

Preferably the solution is agitated by means of a roller located within the gap defined by the wall of the chamber and the central member.

The invention further provides an apparatus for processing photographic material comprising a chamber adapted to hold the material therein, means for introducing solution into the chamber, means for removing the solution from the chamber, a member located within the chamber and filling a central part thereof, a gap being defined between the inner circumferential wall of the chamber and the central member, the central member having at least one nest defined therein.

The invention further provides a method of loading film into a processor wherein the material is introduced into the chamber with both the chamber and the central member being stationary, the fed material entering a nest defined in the central member and forming a roll therein, once the material is fully introduced into the chamber the chamber being rotated and the central member remaining stationary thus unrolling the material along the inner circumference of the chamber for processing.

Preferably concave rollers are used to prevent damage to the film and prevent sticking of the wetted emulsion.

The present invention allows various widths of film to be loaded into a single drum processing chamber. It is not necessary for the drum chamber to have edge guides. Any length of film, up to the circumference of the chamber, can be loaded into the chamber. The film may remain attached to the film cassette during processing.

Having a member filling a central part of the chamber cuts down on heat loss and evaporation of the processing solution. This leads to energy saving and more economic running of the processor.

BRIEF DESCRIPTION OF THE DRAWINGS

The invention will now be described, by way of example, with reference to the accompanying drawings, in which.

DETAILED DESCRIPTION OF THE INVENTION

Figure 1:
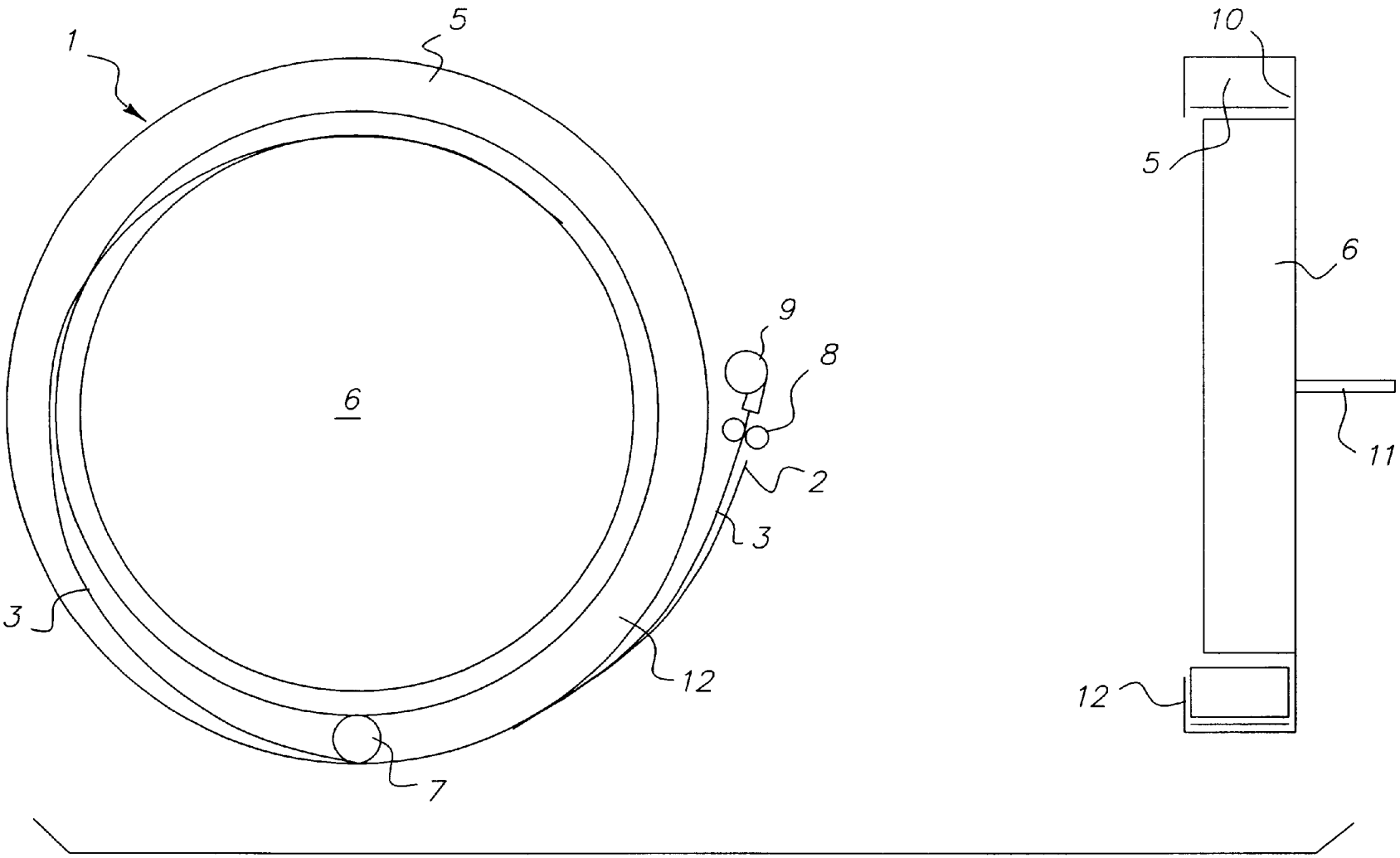
FIG. 1 is a schematic view of an embodiment of the invention.

FIG. 1 shows a processor in accordance with the invention and in which the method of the invention may be performed.

The processor comprises a cylinder 1 having an open side or end and a closed side or end. The cylinder may be made of stainless steel, plastics or any other suitable material. The cylinder defines a processing drum chamber 4. A slot 2 with a water tight cover (not shown) is provided through the wall of the cylinder to allow a strip of film 3 to be loaded into the drum chamber 4. A pair of pinch rollers 8 are provided at the entry to the slot 2. A drive shaft 11 is provided at the closed side or end of the cylinder 1 for rotation thereof. The open end of the cylinder is provided with a flange 12. The flange retains solution within the processing chamber. Processing solutions may be introduced into and removed from the chamber by any suitable means.

A central cylindrical member 6 is located within the processing chamber 4. In the embodiment shown in FIG. 1 the member 6 is solid. However, the member 6 may have a hollow interior. The gap between the outer wall of the member 6 and the inner circumferential wall 5 of the chamber can be any distance from the film thickness to the radius of the chamber. Preferably however the gap will be in the order of 10 to 30 mm. The member 6 provides a film retaining means, preventing the film 3 from falling into the centre of the chamber 4. In one embodiment of the invention the member 6 is attached to the enclosed end 10 of the processing chamber 1 so that it rotates as the chamber rotates. However, in another embodiment, the member 6 may be mounted such that it rotates independently of the chamber. This could be by means of a concentric drive shaft with a clutch assembly.

An agitation roller 7 may be provided in the lower part of the chamber 6. The roller 7 has a diameter of about 1 cm to 3 cm. In this embodiment it is preferred that the gap is sufficiently large to allow the agitation roller 7 to pass freely between the inner circumferential wall 5 and the central cylindrical member 6. Also in practice it is preferred that the gap is sufficiently small so that it properly prevents the film from falling into the centre.

The agitation roller 7 is important as it provides agitation and solution mixing. The roller also prevents the emulsion side of the film 3 sticking to the central cylindrical member 6 when it is wet.

The cylindrical member 6 can be made of any material but it is preferable that it is made of a material that will not damage the film surface. This material can be soft plastic or rubber and can have a textured surface such as that found in "soft touch" rubber rollers used for the so called "tendency drive" method. The inner circumference of the drum chamber 4 may also be made of the same soft material.

In operation the film 3 is loaded through the entry slot 2 by the pinch rollers 8 while the drum 1 is stationary. The film is fed into the processing chamber 4 with the emulsion side facing inwards. As the film is fed into the chamber it passes under the agitation roller 7. The film is passed in until the end of the film 3 is reached when it is held by the pinch rollers 8. The film may be left attached to the cassette 9 or detached from the cassette and driven in by rotation of the cylindrical member 6. Processing solutions are then added and removed as required in order to process the film. Full details of the method of processing can be found in co-pending application no GB 0023091.2, the contents of which are herein incorporated. As can be seen various widths of film can be loaded into a single chamber and processed satisfactorily.

Although edge guides are not necessary they can still be used even though the chamber has a central cylindrical member filling the centre thereof. If edge guides are used then the widest film is loaded and is retained by both the edge guides. When using narrower film the film can be loaded using the edge guide on one side and the central cylindrical member prevents the other side of the film falling into middle of the chamber. Thus it can be beneficial to have the middle of the chamber filled and also to use edge guides as well.

Figure 2:
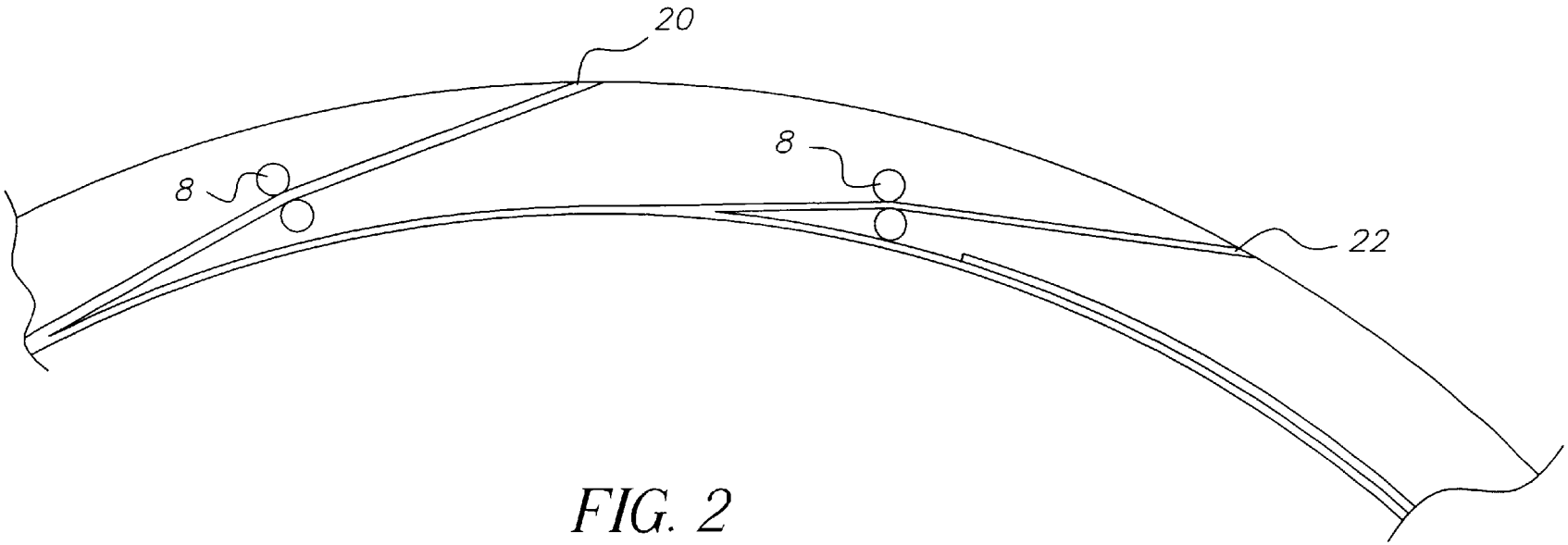
FIG. 2 is an enlarged view of the apparatus with a double entry slot.
Figure 3A:
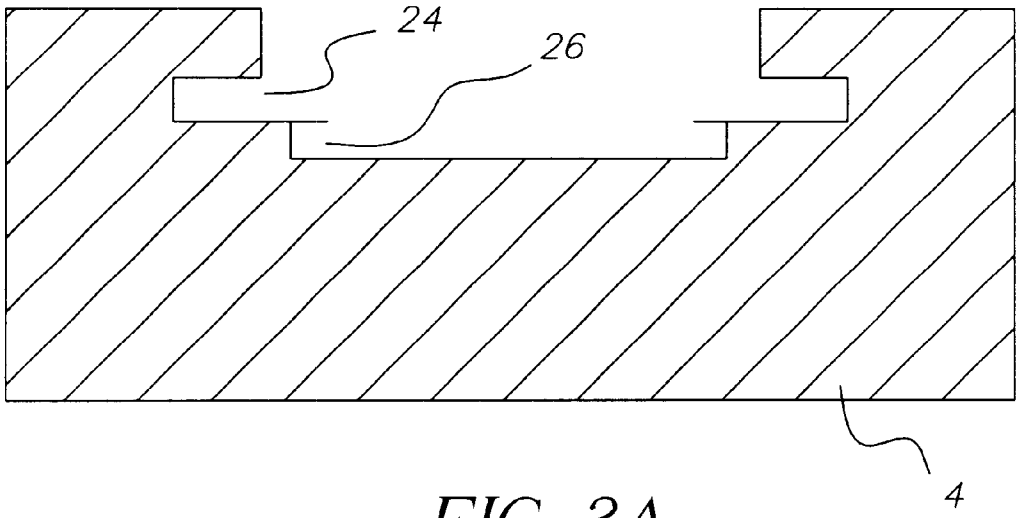
FIGS. 3A and 3B are schematic cross-sectional views of the double entry slot.
Figure 3B:
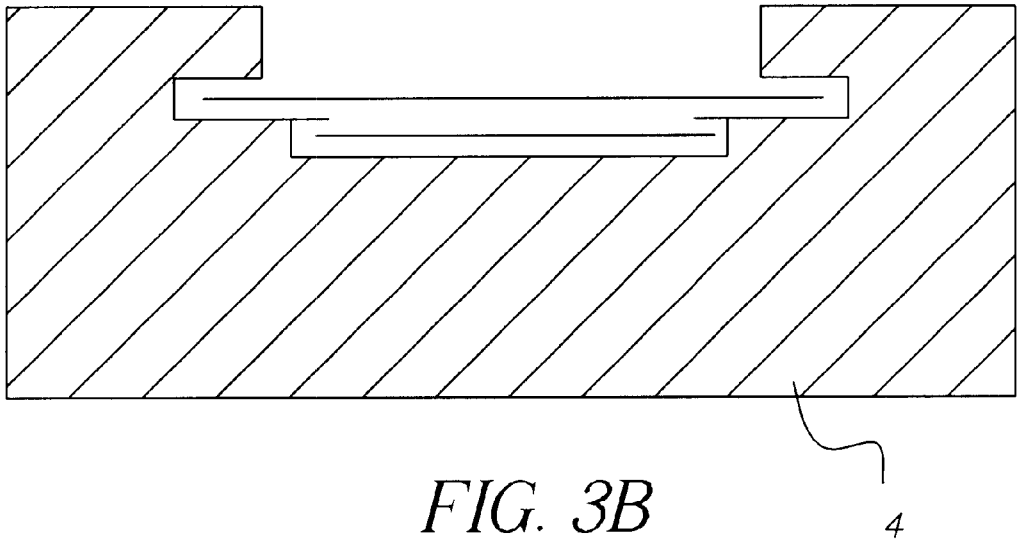

FIGS. 2, 3A and 3B illustrate an embodiment of the invention which allows two widths of film to be loaded into the chamber without the need for the central member 6 preventing the narrower film from falling into the middle of the chamber.

In the embodiment of FIG. 2 two slots 20 and 22 are provided in the wall of the cylinder to allow film 3 to be loaded into the drum chamber 4. Both slots are provided with water tight covers (not shown). Each slot has a pair of pinch rollers 8 provided at the entry thereof. Narrow channels or guide means 24 and 26 are defined in the wall of drum chamber 4. Slots 20 and 22 are in connection with narrow channels, 24 and 26, respectively. The distance of the slots from the pair of pinch rollers to the entrance to the channels is in the region of 15 mm to 50 mm, preferably 15 mm to 25 mm. Channel 24 has a width suitable for wide film, such as 35 mm film. Channel 26 has a width suitable for narrower film, such as 24 mm film.

In operation the film 3 is fed into either slot 20 or 22, dependent on the width of the film, by the pinch rollers 8 as described above.

It will be appreciated that although FIG. 3B illustrates how both widths of film are retained within the slots in practice only one film will be loaded at a time.

As stated above, the central cylindrical member 6 may be fixed to the closed end of the chamber to rotate therewith or it may be mounted such that it rotates independently of the chamber. The latter embodiment has benefits in assisting film loading and unloading and in preventing scuffing of the surface of the film. In a further embodiment the central cylindrical member 6 may be rotated at a different speed to that of the chamber. In such an embodiment the difference in speeds of the member 6 and the drum chamber 4 provides sufficient agitation to process the film satisfactorily. Therefore a roller is not required. In yet a further embodiment the member 6 may rotate in the opposite direction to the rotation of the chamber. This provides a very high degree of agitation through solution shear. It is also envisaged that the chamber 4 may remain stationary and only the member 6 rotate.

If the inner circumferential wall 5 is made of a soft, flexible material, as described above, the film 3 may be fed into the processing chamber 4 emulsion side out. The cylindrical member 6 rotates to assist in loading the film. The film 3 is loaded completely without holding on to the film trailing end. The back of the film contacts the cylindrical member 6 and the front of the film or emulsion side contacts the inner circumferential wall 5 of the drum chamber. The film can slide easily over both the cylindrical member 6 and the inner circumferential wall 5 of the drum chamber. However, it is arranged that the friction between the rotating cylindrical member 6 and the back of the film is greater than the friction between the stationary inner circumferential wall 5 of the drum chamber. This means that although the film 3 can slide on both surfaces it is normally driven round with the rotating cylindrical member 6 and slides over the stationary inner circumferential wall of the drum chamber. This is the first processing mode. In order to effectively wash the back of the film a second processing mode may be provided. In this case a movable stop section (not shown) can be placed in the path of the rotating film. This stop section is adjacent to the entry slot 2 and when the leading end of the film comes up against the stop the film can no longer rotate. This causes the rotating cylindrical member 6 to rotate and thus wash the back of the film 3. The stop section also serves a second purpose and that is to enable unloading of the film. After the last wash the stop section is in the down position, the rotating cylindrical member 6 is now rotated in the opposite direction so that the trailing end of the film comes up against the other side of the stop section. This side of the stop section is angled so as to be in line with the entry slot 2 and so the trailing end of the film is guided out of the entry slot and into the pair of pinch rollers 8. Thus the film is unloaded.

Figure 4:
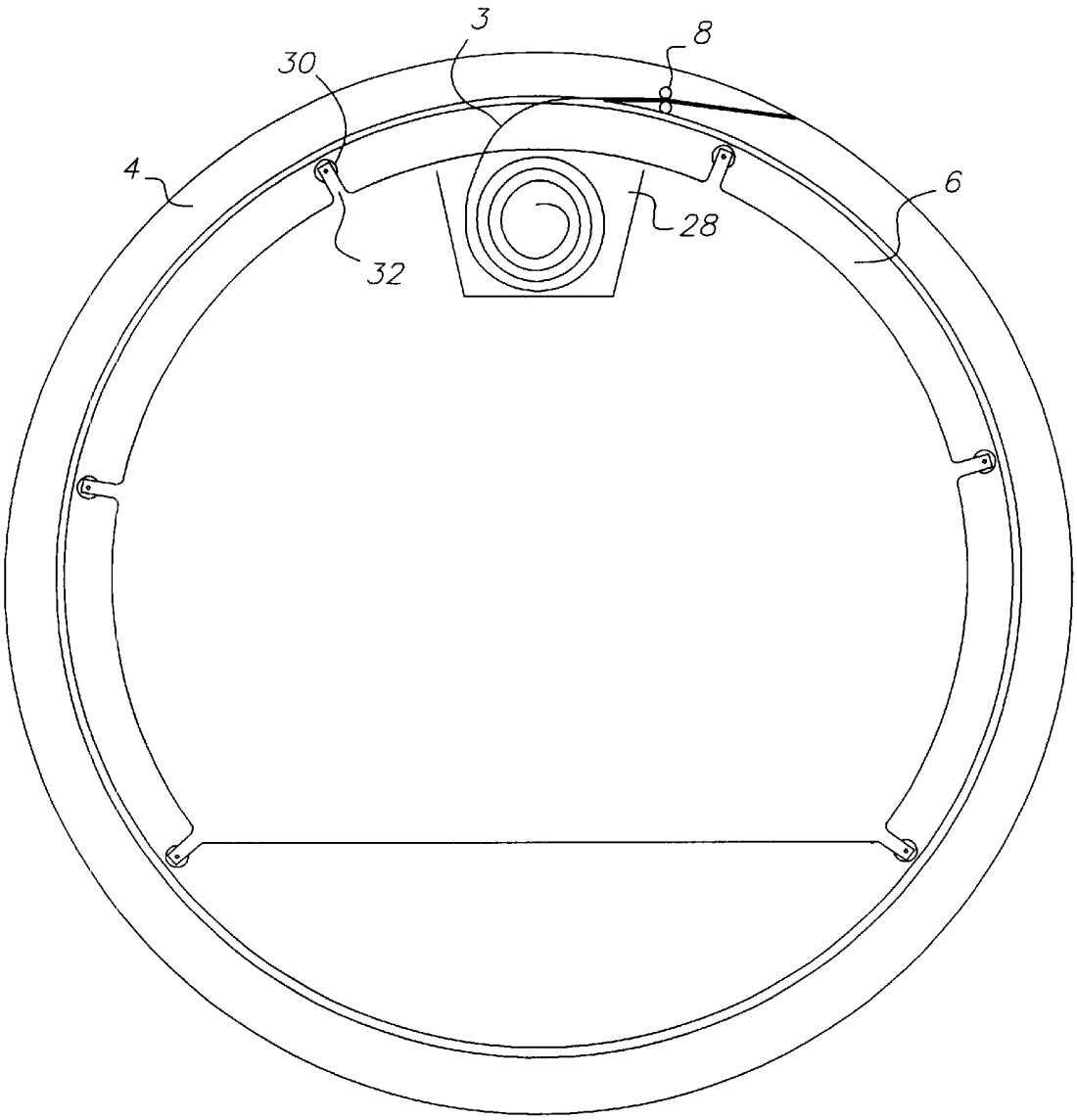
FIG. 4 illustrates a method of loading according to the invention.

FIG. 4 illustrates a further apparatus and method of loading according to the invention.

In this embodiment a slot is provided in the wall of the of the cylinder to allow film 3 to be loaded into the drum chamber 4 as described above. A pair of pinch rollers 8 are provided, also as described above. The drum chamber 4 has a filled central member 6. A plurality of rollers 30 are provided on the outer perimeter of the central member 6, projecting out therefrom on arm members 32. The rollers are on arm members 32 to prevent damage to the film surface. The rollers 30 each have a concave section such that only the outside edge of the film 3 contacts the rollers when the film is loaded in the chamber. The rollers have a diameter between 2 mm and 50 mm, preferably 6 mm. The gap between the rollers 30 and the inner circumference of the drum chamber 4 can be a maximum of 50 mm. However the ideal range is from the thickness of the film to 6 mm. At least one cavity, or nest, 28 is provided within the central member.

Film is fed into the drum chamber 4 by the pair of pinch rollers 8. Both the drum 4 and central member 6 are held stationary as the film 3 is fed into the chamber. The natural curl of the film 3 means that as the film is fed into the chamber 4 it curls up on itself within the nest 28 provided within the central member 6. Once the film has been loaded the end of the film is held by the pinch rollers 8. The drum 4 is then rotated in the direction shown by the arrow in FIG. 4. The central member 6 remains stationary. The film is thus uncurled by the rollers 30 and is drawn out of the nest 28 to lie around the inner circumference of the chamber. At this stage the film is held only by the rollers 30. As the rollers are concave only the outer edges of the film contact the surface thereof thus minimizing damage to the surface of the film. Processing then takes place as described above. As the film gets warm and soft during the processing the strength of its natural curl is lost and eventually the film lies against the inner circumferential wall of the chamber by capillary action.

The film does not have to be fed in at the top of the drum chamber. The film can be loaded, and unloaded, with the entry lot at various positions. The chamber may have more than one entry slot and nest for different sizes of film.

No edge guide means are required in this embodiment, the inner circumferential wall of the chamber being smooth. It is thus easier and cheaper to manufacture this apparatus.

The invention has been described in detail with reference to certain preferred embodiments thereof. It will be understood by those skilled in the art that variations and modifications can be effected within the scope of the invention.

1. Cylinder
2. Slot
3. film
4. drum chamber
5. inner circumferential wall
6. cylindrical member
7. agitation roller
8. rollers
9. cassette
10. enclosed end of cylinder
11. drive shaft
12. flange
20. slot
22. slot
24. guide channel
26. guide channel
28. nest
30. rollers
32. arm member

What is claimed is:

1. An apparatus for processing photographic material comprising a rotatable chamber adapted to hold the material therein, means for introducing solution into the rotatable chamber, means for removing the solution from the chamber, and a member located within the chamber and filling a central part thereof, a gap being defined between the inner circumferential wall of the chamber and the central member in which the material is located, thereby to retain the material around the inner circumference of the chamber.

2. An apparatus as claimed in claim 1 wherein the member is fixed to the chamber such that the member rotates with the chamber.

3. An apparatus as claimed in claim 1 wherein the member is a solid assembly.

4. An apparatus as claimed in claim 1 wherein film edge guide means are provided on the inner circumferential wall of the chamber.

5. An apparatus as claimed in claim 1 wherein at least two film guide channels of differing widths are provided in the inner circumferential wall of the chamber, each channel having a separate entrance slot provided through the wall of the chamber.

6. An apparatus as claimed in claim 1 further including a movable stop section for stopping rotation of the film within the chamber.

7. An apparatus as claimed in claim 1 further including a nest defined in the central member, the nest being sized to accommodate the fed material in roll form.

8. An apparatus as claimed in claim 1 wherein the member is fixed to the chamber such that the member rotates independently to the chamber.

9. An apparatus as claimed in claim 1 further including a roller located within the gap.

10. An apparatus as claimed in claim 9 wherein the roller has a diameter of 1 cm to 3 cm.

11. An apparatus as claimed in claim 1 wherein the central member is made of a soft plastics material.

12. An apparatus as claimed in claim 1 wherein the inner circumferential wall is made of a soft plastics material.

13. An apparatus as claimed in claim 1 wherein the member is a hollow assembly.

14. An apparatus for processing photographic material comprising a chamber adapted to hold the material therein, means for introducing solution into the chamber, means for removing the solution from the chamber, at least two entrance slots for the material to be processed being provided through the wall of the chamber and an equal number of film guide channels, of differing widths, provided in the inner circumferential wall of the chamber, thereby to guide and retain the material around the inner circumference of the chamber.

15. An apparatus for processing photographic material comprising a chamber adapted to hold the material therein, means for introducing solution into the chamber, means for removing the solution from the chamber, a member located within the chamber and filling a central part thereof, a gap being defined between the inner circumferential wall of the chamber and the central member, the central member having at least one nest defined therein.

16. An apparatus as claimed in claim 15 wherein the member is fixed to the chamber such that the member rotates independently to the chamber.

17. An apparatus as claimed in claim 15 further including a roller located within the gap.

18. An apparatus as claimed in claim 17, wherein the roller has a diameter of 1 cm to 3 cm.

19. An apparatus as claimed in claim 15 wherein the central member is made of a soft plastics material.

20. An apparatus as claimed in claim 15 wherein the inner circumferential wall is made of a soft plastics material.

21. An apparatus as claimed in claim 15 wherein the member is a hollow assembly.

22. An apparatus as claimed in claim 15 wherein a plurality of rollers are provided on the outer perimeter of the central member, the rollers being located on the outer end of arms projecting from the central member.

23. An apparatus as claimed in claim 22 wherein the rollers have a concave section such that only the outer edge of the material contacts the rollers.

24. An apparatus as claimed in claim 23 wherein the rollers have a diameter of 2 mm to 50 mm.

25. An apparatus as claimed in claim 22 wherein the distance between the rollers and the inner circumferential wall of the chamber is a maximum of 50 mm.

26. A method of loading material to be processed into an apparatus as claimed in claim 15 wherein the material is introduced into the chamber with both the chamber and the central member being stationary, the fed material entering the nest defined in the central member and forming a roll therein, once the material is fully introduced into the chamber the chamber being rotated and the central member remaining stationary thus unrolling the material along the circumference of the chamber for processing.

27. A method as claimed in claim 26 wherein the end of the material is held and located by feed rollers.

28. A method as claimed in claim 26, wherein the material is loaded into the chamber with the chamber at any rotational position.

29. A method of processing photographic material comprising the steps of loading the material into a rotatable processing chamber the central part of which is filled by a central member, the walls of the rotatable chamber and the central member defining a gap in which the material is located, introducing processing solution into the chamber, agitating the solution and removing the solution from the chamber.

30. A method as claimed in claim 29 wherein the solution is agitated by rotating the processing chamber and the central member at different speeds.

31. A method as claimed in claim 29 wherein the solution is agitated by rotating the processing chamber and the central member in opposite directions.

32. A method as claimed in claim 29 wherein the solution is agitated by rotating the central member while keeping the chamber stationary.

33. A method as claimed in claim 29 wherein the solution is agitated by means of a roller located within the gap defined by the wall of the chamber and the central member.

34. A method as claimed in claim 29 wherein the processing chamber is heated by heating the central member.

35. A method as claimed in claim 29 wherein the chamber is heated by filling the central member with liquid at a controllable temperature.

* * * * *